US008177495B2

(12) United States Patent
Bowes et al.

(10) Patent No.: US 8,177,495 B2
(45) Date of Patent: May 15, 2012

(54) METHOD AND APPARATUS FOR TURBINE INTERSTAGE SEAL RING

(75) Inventors: Christopher Sean Bowes, Simpsonville, SC (US); Ian David Wilson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 542 days.

(21) Appl. No.: 12/409,687

(22) Filed: Mar. 24, 2009

(65) Prior Publication Data

US 2010/0247294 A1 Sep. 30, 2010

(51) Int. Cl.
*F01D 9/00* (2006.01)
*F01D 5/00* (2006.01)

(52) U.S. Cl. ..... 415/174.4; 415/174.2; 416/196 R

(58) Field of Classification Search ..... 415/138, 415/209.1, 173.7, 208.2, 141, 174.2, 174.4; 277/641; 416/220 R, 52, 194, 195, 196 R
See application file for complete search history.

(56) References Cited

U.S. PATENT DOCUMENTS 4,088,422 A 5/1978 Martin
4,659,289 A 4/1987 Kalogeros
4,820,119 A 4/1989 Joyce
4,884,950 A 12/1989 Brodell et al.
5,236,302 A 8/1993 Weisgerber et al.
5,275,534 A 1/1994 Cameron et al.
5,288,210 A 2/1994 Albrecht et al.
5,318,405 A 6/1994 Meade et al.
5,338,154 A 8/1994 Meade et al.
5,352,087 A 10/1994 Antonellis
5,749,701 A 5/1998 Clarke et al.
5,758,487 A 6/1998 Salt et al.
6,139,264 A * 10/2000 Schilling ..... 415/174.2
6,283,712 B1 9/2001 Dziech et al.
6,398,488 B1 6/2002 Solda et al.
6,464,453 B2 * 10/2002 Toborg et al. ..... 415/115
6,564,453 B2 5/2003 Tamai et al.
6,679,679 B1 * 1/2004 Debeneix et al. ..... 415/139
6,832,892 B2 12/2004 Murphy et al.
6,899,520 B2 5/2005 Habedank et al.
6,916,154 B2 * 7/2005 Synnott ..... 415/208.2
7,001,145 B2 2/2006 Couture et al.
7,309,210 B2 * 12/2007 Suciu et al. ..... 415/174.2

* cited by examiner

*Primary Examiner* — Caridad Everhart
(74) *Attorney, Agent, or Firm* — Armstrong Teasdale LLP

(57) ABSTRACT

A seal assembly for a gas turbine engine including a seal member and an interstage seal ring including an axially forward member coupled to a first radially inward surface of a first disk and an axially aft member coupled to a second radially inward surface of a second disk, wherein the seal ring is configured to move in an axial direction while the upstream and downstream arms are coupled to the first and second disk respectively.

18 Claims, 3 Drawing Sheets

METHOD AND APPARATUS FOR TURBINE INTERSTAGE SEAL RING

BACKGROUND OF THE INVENTION

This invention relates generally to gas turbine engines, and more specifically to seal assemblies used with gas turbine engine rotor assemblies.

At least some known gas turbine engines include a core engine having, in serial flow arrangement, a fan assembly and a high pressure compressor, which compress airflow, entering the engine. A combustor ignites a fuel-air mixture, which is then channeled towards low and high pressure turbines that each include a plurality of rotor blades that extract rotational energy from airflow exiting the combustor. The high pressure compressor is coupled by a shaft to the high pressure turbine.

Generally, high pressure turbines include a first stage coupled to a second stage disk by a bolted connection. More specifically, the rotor shaft extends between a last stage of the multi-staged compressor and the web portions of the turbine first stage disk. The first and second stage turbine disks are isolated by a forward faceplate that is coupled to a forward face of the first stage disk, and an aft seal that is coupled to a rearward face of the second stage disk web. An interstage seal assembly extends between the first and second stage disks to facilitate sealing flow around a second stage turbine nozzle.

Commonly, interstage seal assemblies include an interstage seal and a separate blade retainer. The interstage seal is coupled to the first and second stage disks with a plurality of bolts. The blade retainer includes a split ring that is coupled to an axisymmetric hook assembly extending from the turbine stage disk. However, because the seal assemblies are complex, such interstage seal assemblies may be difficult to assemble. To facilitate reducing the assembly time and costs of such seal assemblies, other known interstage seal assemblies include an integrally-formed interstage seal and blade retainer. However, these seal assemblies while cheaper and easier to assemble, do not allow for inspection of the rotor sub-assemblies after assembly and prior to final location of the interstage seal.

BRIEF DESCRIPTION OF THE INVENTION

In one aspect, a seal assembly for a gas turbine engine includes a seal member and an interstage seal ring including an axially forward member coupled to a first radially inward surface of a first disk and an axially aft member coupled to a second radially inward surface of a second disk, wherein the seal ring is configured to move in an axial direction while the upstream and downstream arms are coupled to the first and second disk respectively.

In another aspect, a method for assembling a seal assembly for a gas turbine engine rotor assembly includes coupling a seal ring to a first disk such that an upstream arm of the seal ring engages a first radially inward surface of the first disk and coupling the seal ring to a second disk such that a downstream arm of the seal ring engages a second radially inward surface of the second disk, wherein the seal ring is configured to move in an axial direction while the upstream and downstream arms are coupled to the first and second disk, respectively.

In a further aspect, a gas turbine engine includes a fan and combustor in serial flow communication and a rotor assembly comprising, a first disk, a second disk, and a seal assembly extending between the first disk and the second disk. The seal assembly includes a seal member and an interstage seal ring, the interstage seal ring includes, a forward member coupled to a radially inward surface of the first disk and an aft member coupled to a radially inward surface of the second disk wherein the seal ring is configured to move in an axial direction while the upstream and downstream arms are coupled to the first and second disk. respectively.

BRIEF DESCRIPTION OF THE DRAWING

FIG. 1 is a schematic illustration of a gas turbine engine;

FIG. 2 is an enlarged partial cross-sectional view of a portion of the gas turbine engine shown in FIG. 1;

FIG. 3 is an enlarged partial cross-sectional view of a portion of the gas turbine engine shown in FIG. 1 which shows the seal ring assembled and slid forward; and FIG. 4 is an enlarged partial cross-sectional view portion of the gas turbine engine shown in FIG. 2 which shows the seal ring assembled and the retainer cutout.

DETAILED DESCRIPTION OF THE INVENTION

Figure 1:
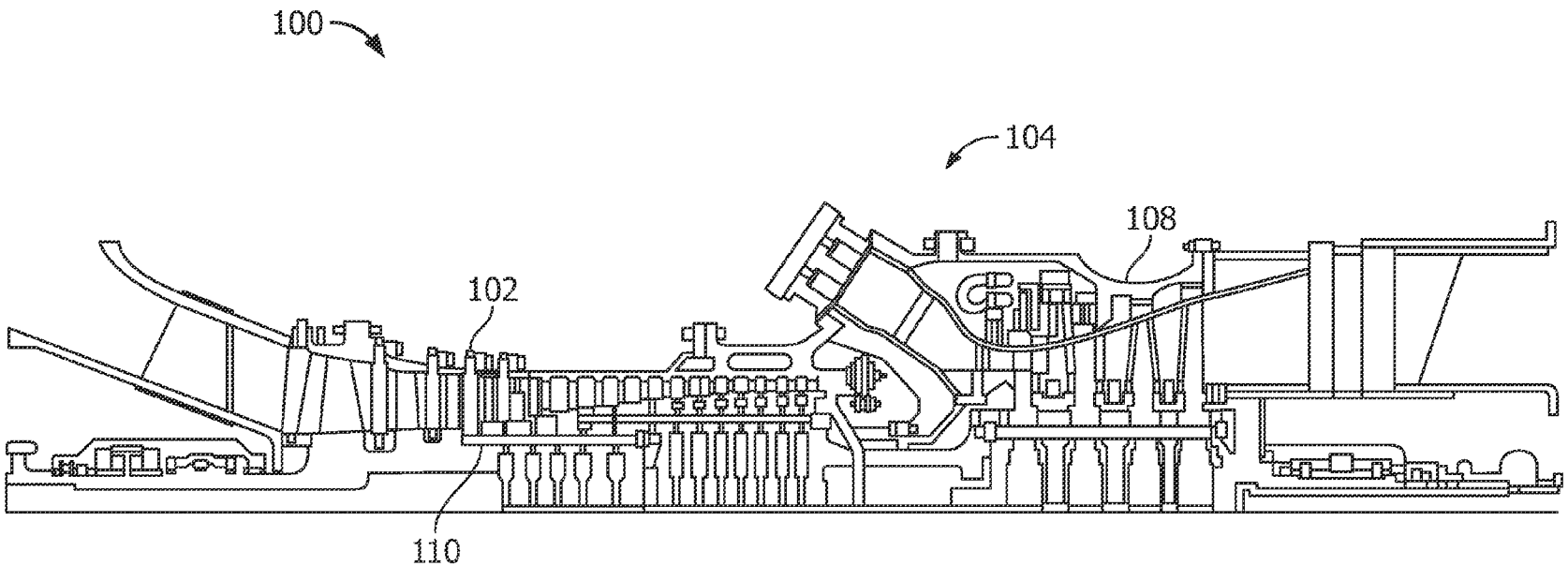
FIGS. 1-4 show exemplary embodiments of the method and apparatus described above.

FIG. 1 is a schematic illustration of an exemplary gas turbine engine 100. Engine 100 includes a compressor assembly 102 and a combustor assembly 104. Engine 100 also includes a turbine 108 and a common compressor/turbine shaft 110 (sometimes referred to as a rotor 110).

In operation, air flows through compressor assembly 102 such that compressed air is supplied to combustor assembly 104. Fuel is channeled to a combustion region and/or zone (not shown) that is defined within combustor assembly 104 wherein the fuel is mixed with the air and ignited. Combustion gases generated are channeled to turbine 108 wherein gas stream thermal energy is converted to mechanical rotational energy. Turbine 108 is rotatably coupled to shaft 110. It should also be appreciated that the term "fluid" as used herein includes any medium or material that flows, including, but not limited to, gas and air.

Figure 2:
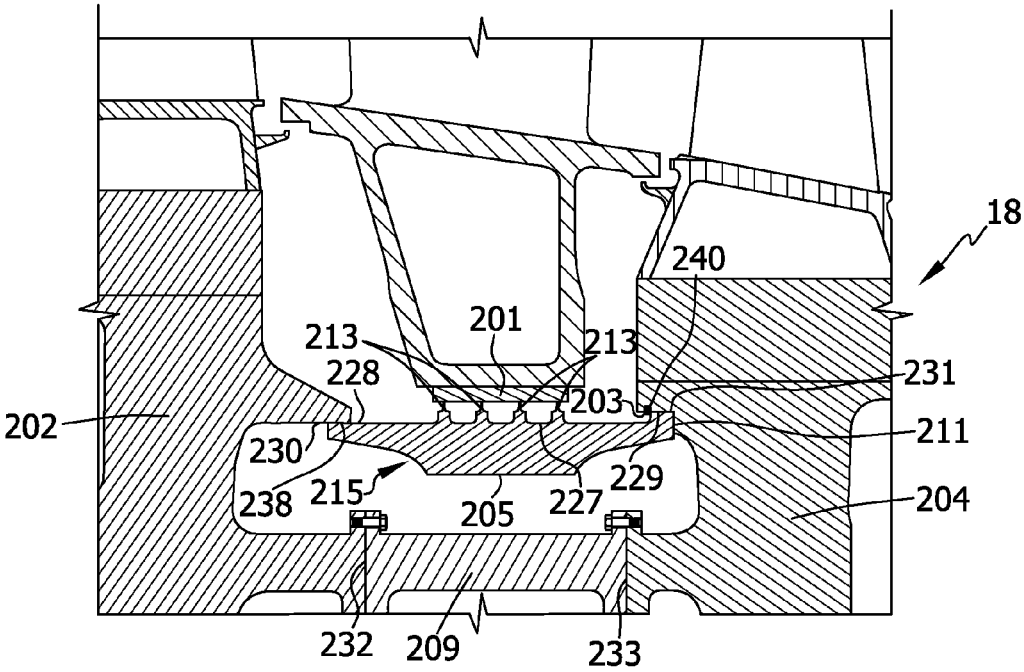

FIG. 2 is an enlarged partial cross-sectional view of a portion of gas turbine engine 100. Specifically, FIG. 2 illustrates an enlarged partial cross-sectional view of turbine 108. Turbine 108 includes a first stage disk 202 and a second stage disk 204.

An interstage seal assembly 215 extends axially between turbine first and second disks 202 and 204. More specifically, seal assembly 215 includes a seal member 201, a seal ring 205, and a retainer 203. In one embodiment, seal ring 205 is generally cylindrical and includes a mid portion 227, a first seal assembly surface 228, and a second seal assembly surface 229. However, in other embodiments, seal ring 205 may be an assembly of parts coupled together. Additionally, although in the exemplary embodiment the seal ring 205 comprises a cylindrical cross-section seal ring 205 is not limited to a cylindrical cross-section and for example, could have a catenary cross-section. Seal assembly surfaces 228 and 229 extend axially forward and aft, respectively from mid portion 227 to provide a contact area between seal ring 205 and first and second stage disks 202 and 204. Seal assembly surfaces 228 and 229 are configured to create interference or rabbetted fits between first stage disk surface 230 and second disk surface 231 respectively. In various other embodiments, other fastener or attachment means may be used. In the exemplary embodiment the seal ring 205 includes a male rabbeted fit configured to engage a female rabbet on at least one of the first disk 202 and the second disk 204. Mid portion 227 includes a plurality of seal teeth 213 which engage with seal member 201.

Figure 3:
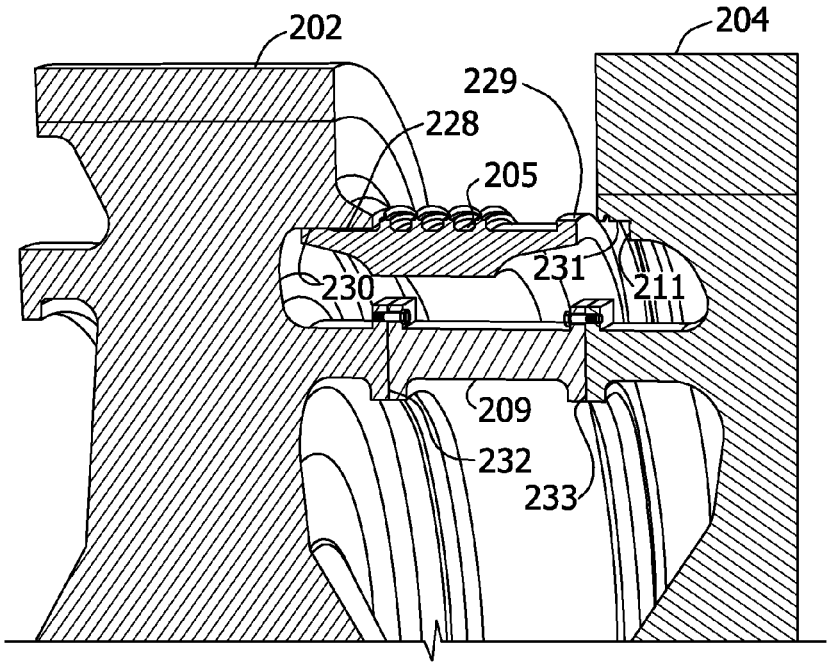
Figure 4:
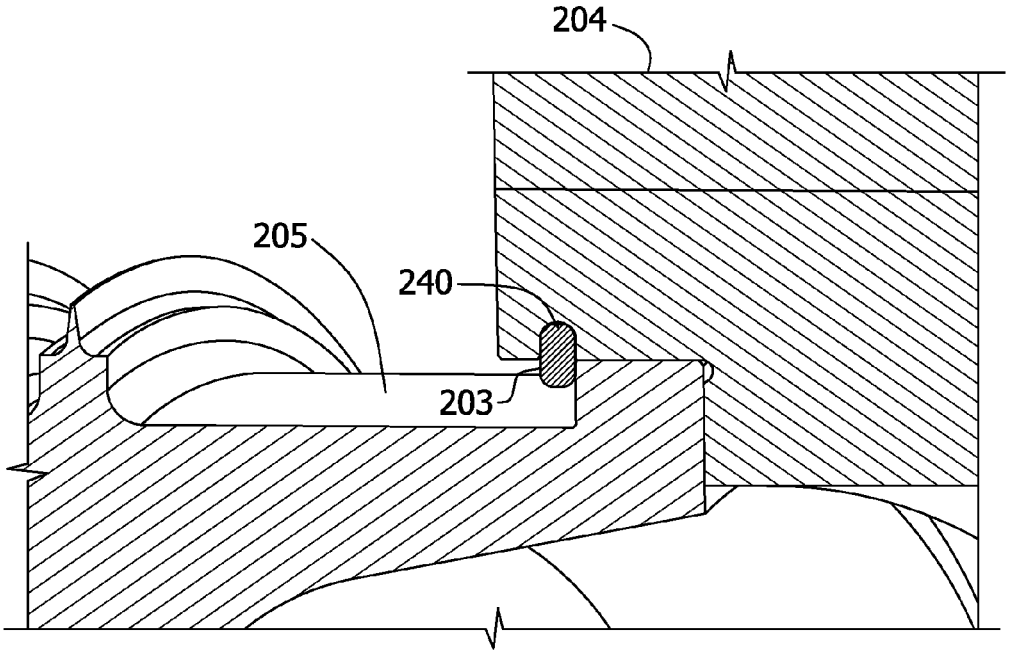

FIG. 3 is an enlarged view of a portion of the gas turbine engine shown in FIG. 1. More specifically, FIG. 3 illustrates a positioning of seal ring 205 during assembly. During assembly, a spacer 209 is coupled to an aft edge 232 of first disk 202. Then seal ring 205 is cooled to a substantially cooler temperature than first disk 202. This temperature difference allows assembly surface 228 to slideably engage a radially interior surface 230 of first disk 202. While still cooled, seal ring 205 is slid forward. This allows spacer 209 to be coupled to assembly surface 233 of second disk 204. Next, seal ring 205 is again cooled, to a substantially lower temperature than both first disk 202 and second disk 204 and slid aft so that assembly surface 231 engages seal assembly surface 229 and seal ring 205 is axially restrained from further aft movement by surface 211 on second disk 202. Finally, a retainer 203 may be coupled to second disk 204 at cutout 240 to restrain the axially forward movement of seal ring 205. In the exemplary embodiment retainer 203 is a pin. In other embodiments retainer 203 could use any other means of attachment, such as, but not limited to bolts, wire retention, and bucket retention FIG. 4 is an enlarged partial view of FIG. 2 illustrating seal ring 205 after installation. After installation, seal ring 205 may be easily relocated to allow inspection of surfaces 232 and 233. In another embodiment, seal ring 205 may be relocated to allow assembly and disassembly of parts that are inaccessible when seal ring 205 is in the installed position. First, retainer 203, if used, is removed. Then seal ring 205 is cooled to a substantially lower temperature than first and second disks. 202 and 204. After cooling, seal ring 205 may be slid forward to allow inspection of surfaces 232 and 233.

Exemplary embodiments of rotor assemblies are described above in detail. The rotor assemblies are not limited to the specific embodiments described herein, but rather, components of each assembly may be utilized independently and separately from other components described herein. For example, each interstage seal assembly component can also be used in combination with other interstage seal assembly components and with other rotor assemblies.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A seal assembly for a gas turbine engine including a first disk and a second disk, said seal assembly comprising:

a seal member;

a spacer radially inward of the seal member, said spacer couples the first disk to the second disk and an interstage seal ring positioned radially between said seal member and said spacer, said interstage seal ring comprising an axially forward member coupleable to a first radially inward surface of the first disk and an axially aft member coupleable to a second radially inward surface of the second disk, said seal ring configured to move in an axial direction between a first position in which the axially aft member remains a distance from said second radially inward surface such that a gap is defined therebetween and a second position in which said axially aft member contacts said second radially inward surface, wherein the gap provides access to said spacer from radially outward of said spacer.

2. A seal assembly in accordance with claim 1 wherein at least one of said axially forward member and said axially aft member are coupled with an interference fit.

3. A seal assembly in accordance with claim 1, wherein said seal ring further comprises a separable assembly.

4. A seal assembly in accordance with claim 1 further comprising a retainer coupled to the second disk, said retainer configured to limit axial movement of the interstage seal ring.

5. A seal assembly in accordance with claim 4 wherein said retainer comprises at least one of a pin, a wire, and a bolt.

6. A method for assembling a seal assembly for a gas turbine engine rotor assembly, said method comprising:

coupling a spacer to an upstream side of a first disk of the gas turbine engine;

coupling a seal ring to the first disk such that an upstream arm of the seal ring engages a first radially inward surface of the first disk;

coupling the spacer to an upstream side of a second disk of the gas turbine engine after coupling the seal ring to the first disk; and coupling the seal ring to the second disk such that a downstream arm of the seal ring engages a second radially inward surface of the second disk, wherein the seal ring is sized to move in an axial direction between a first position in which the seal ring remains a distance from said second radially inward surface such that a gap is defined therebetween and a second position in which the axially aft member contacts the second radially inward surface, wherein the gap provides access to the spacer from radially outward of the spacer.

7. A method in accordance with claim 6 wherein coupling a seal ring to a first disk further comprises engaging the upstream arm of the seal ring and the radially inward surface of the first disk with an interference fit.

8. A method in accordance with claim 6 wherein coupling a seal ring to a second disk further comprises engaging the downstream arm of the seal ring and the radially inward surface of the second disk with an interference fit.

9. A method in accordance with claim 6 wherein coupling the seal ring to a first disk further comprises coupling the seal ring to the first disk, wherein the seal ring comprises a separable assembly.

10. A method in accordance with claim 6 further comprising coupling a retainer to the second disk.

11. A method in accordance with claim 10 wherein coupling a retainer to the second disk further comprises coupling the retainer to the second disk, wherein the retainer comprises at least one of a pin, a wire, and a bolt.

12. A gas turbine engine comprising:

a fan and combustor coupled in serial flow communication; and a rotor assembly comprising:

a first disk;

a second disk;

a seal assembly extending between the first disk and the second disk, a spacer located radially inward of the seal member that connects the first disk to the second disk, wherein the seal assembly comprises:

an interstage seal ring, said interstage seal ring comprising:

a forward member coupleable to a radially inward surface of said first disk and an aft member coupleable to a radially inward surface of said second disk, said seal ring is configured to move in an axial direction between a first position in which the aft member remains a distance from said second radially inward surface such that a gap is defined therebetween and a second position in which the axially aft member contacts the second radially inward surface, wherein the gap provides access to the spacer from radially outward of the spacer.

13. A gas turbine engine in accordance with claim 12 wherein said interstage seal ring further comprises a separable assembly.

14. A gas turbine engine in accordance with claim 12 wherein said forward member is coupled to the first disk using an interference fit.

15. A gas turbine engine in accordance with claim 12 wherein said aft member is coupled to the second disk using an interference fit.

16. A gas turbine engine in accordance with claim 12 wherein said interstage seal ring is in compression when said seal assembly is coupled to said first and second disks.

17. A gas turbine engine in accordance with claim 12 wherein said seal assembly further comprises a retainer coupled to said second disk, said retainer configured to restrain axial movement of said interstage seal ring.

18. A gas turbine engine in accordance with claim 17 wherein said retainer comprises at least one of a pin, a wire, and a bolt.

* * * * *